US012129006B2

(12) United States Patent
Ross

(10) Patent No.: US 12,129,006 B2
(45) Date of Patent: Oct. 29, 2024

(54) MARINE VESSEL WITH GYROSCOPE-ASSISTED JOYSTICK MANEUVERING

(71) Applicant: Brunswick Corporation, Mettawa, IL (US)

(72) Inventor: Walter B. Ross, Middlebury, IN (US)

(73) Assignee: Brunswick Corporation, Mettawa, IL (US)

( * ) Notice: Subject to any disclaimer, the term of this patent is extended or adjusted under 35 U.S.C. 154(b) by 484 days.

(21) Appl. No.: 17/391,419

(22) Filed: Aug. 2, 2021

(65) Prior Publication Data

US 2023/0030018 A1 Feb. 2, 2023

(51) Int. Cl.

| | |
|---|---|
| ***B63H 25/42*** | (2006.01) |
| ***B63H 20/00*** | (2006.01) |
| ***B63H 20/12*** | (2006.01) |
| ***B63H 25/02*** | (2006.01) |

(52) U.S. Cl.

CPC ..... *B63H 25/42* (2013.01); *B63H 20/12* (2013.01); *B63H 2020/003* (2013.01); *B63H 2025/026* (2013.01)

(58) Field of Classification Search

CPC ..... B63B 39/04; B63H 25/42; B63H 20/12; B63H 2020/003; B63H 2025/026

See application file for complete search history.

(56) References Cited

U.S. PATENT DOCUMENTS

| | | | | |
|---|---|---|---|---|
| 5,787,832 | A * | 8/1998 | Spinka | B63B 43/14 114/123 |
| 6,973,847 | B2 | 12/2005 | Adams et al. | |
| 8,417,399 | B2 | 4/2013 | Arbuckle | |
| 9,248,898 | B1 | 2/2016 | Kirchhoff et al. | |
| 10,671,073 | B2 | 6/2020 | Arbuckle et al. | |
| 10,926,855 | B2 | 2/2021 | Derginer et al. | |
| 2004/0244513 | A1* | 12/2004 | Adams | B63B 39/04 74/5.47 |
| 2005/0274210 | A1 | 12/2005 | Adams et al. | |
| 2007/0089654 | A1* | 4/2007 | Bradley | B63H 21/22 114/10 |
| 2011/0172858 | A1* | 7/2011 | Gustin | B63H 21/213 701/21 |

(Continued)

*Primary Examiner* — Jaime Figueroa
*Assistant Examiner* — Jerrod Irvin Davis
(74) *Attorney, Agent, or Firm* — Andrus Intellectual Property Law, LLP

(57) ABSTRACT

A system for orienting a marine vessel is provided. The system includes marine propulsion devices, a gyroscopic stabilizer system, and a manually operable control device configured to provide an output signal which is representative of a desired movement of the marine vessel. The system further includes a controller operably coupled to the marine propulsion devices, the gyroscopic stabilization system and the manually operable control device. The controller is configured to receive the output signal from the manually operable control device, resolve said desired movement of the marine vessel into a target movement command, operate the marine propulsion devices to exert a thrust on the marine vessel to achieve the target movement command, and operate the gyroscopic stabilizer system consistent with the thrust exerted by the plurality of marine propulsion devices to achieve the target movement command.

18 Claims, 9 Drawing Sheets

(56) References Cited

U.S. PATENT DOCUMENTS

| | | | | |
|---|---|---|---|---|
| 2013/0036959 | A1* | 2/2013 | Steinmann | G01C 21/18 114/122 |
| 2016/0039500 | A1* | 2/2016 | Heyring | B63B 17/0081 114/61.15 |
| 2020/0140051 | A1 | 5/2020 | Derginer et al. | |
| 2020/0140052 | A1 | 5/2020 | Derginer et al. | |
| 2021/0269127 | A1* | 9/2021 | Sohacki | B63B 39/04 |
| 2023/0097909 | A1* | 3/2023 | Miocevich | B63H 20/00 114/122 |

* cited by examiner

MARINE VESSEL WITH GYROSCOPE-ASSISTED JOYSTICK MANEUVERING

FIELD

The present disclosure relates to maneuvering systems for marine vessels, and more specifically, to systems and methods for operating propulsion and gyroscopic stabilization systems in concert to assist in close quarter maneuvers.

BACKGROUND

U.S. Pat. No. 8,417,399 discloses systems and methods for orienting a marine vessel that minimize at least one of pitch and roll in a station keeping mode. A control device having a memory and a programmable circuit is programmed to control operation of the plurality of marine propulsion devices to maintain orientation of a marine vessel in a selected global position and heading. The control device receives at least one of actual pitch and actual roll of the marine vessel in the global position and controls operation of the plurality of marine propulsion units to change the heading of the marine vessel to minimize at least one of the actual pitch and the actual roll while maintaining the marine vessel in the selected global position.

U.S. Pat. No. 9,248,898 discloses a system that controls the speed of a marine vessel that includes first and second propulsion devices that produce first and second thrusts to propel the marine vessel. A control circuit controls orientation of the first and second propulsion devices about respective steering axes to control directions of the first and second thrusts. A first user input device is moveable between a neutral position and a non-neutral detent position. When a second user input device is actuated while the first user input device is in the detent position, the control circuit does one or more of the following so as to control the speed of the marine vessel: varies a speed of a first engine of the first propulsion device and a speed of a second engine of the second propulsion device; and varies one or more alternative operating conditions of the first and second propulsion devices.

U.S. Pat. No. 10,671,073 discloses a method for maintaining a marine vessel at a global position and/or heading includes receiving measurements related to vessel attitude and estimating water roughness conditions based on the measurements. A difference between the vessel's actual global position and the target global position and/or a difference between the vessel's actual heading and the target heading are determined. The method includes calculating a desired linear velocity based on the position difference and/or a desired rotational velocity based on the heading difference. The vessel's actual linear velocity and/or actual rotational velocity are filtered based on the roughness conditions. The method includes determining a difference between the desired linear velocity and the filtered actual linear velocity and/or a difference between the desired rotational velocity and the filtered actual rotational velocity. The method also includes calculating vessel movements that will minimize the linear velocity difference and/or rotational velocity difference and carrying out the calculated movements.

U.S. Pat. No. 10,926,855 discloses a method for controlling low-speed propulsion of a marine vessel powered by a marine propulsion system having a plurality of propulsion devices includes receiving a signal indicating a position of a manually operable input device movable to indicate desired vessel movement within three degrees of freedom, and associating the position of the manually operable input device with a desired inertial velocity of the marine vessel. A steering position command and an engine command are then determined for each of the plurality of propulsion devices based on the desired inertial velocity and the propulsion system is controlled accordingly. An actual velocity of the marine vessel is measured and a difference between the desired inertial velocity and the actual velocity is determined, where the difference is used as feedback in subsequent steering position command and engine command determinations.

U.S. Patent Publication No. 2020/0140051 discloses a propulsion control system for a marine vessel that includes a plurality of propulsion devices steerable to propel the marine vessel, at least one proximity sensor that determines a relative position of the marine vessel with respect to an object, wherein the at least one proximity sensor has a field of view (FOV). A controller is configured to identify a trigger condition for expanding the FOV of the at least one proximity sensor and control thrust and/or steering position of at least one of the plurality of propulsion devices to expand the FOV of the at least one proximity sensor by inducing a roll movement or a pitch movement of the marine vessel.

U.S. Patent Publication No. 2020/0140052 discloses a method for controlling low-speed propulsion of a marine vessel powered by a marine propulsion system having a plurality of propulsion devices that includes receiving a signal indicating a position of a manually operable input device movable to indicate desired vessel movement within three degrees of freedom, and associating the position of the manually operable input device with a desired inertial velocity of the marine vessel. A steering position command and an engine command are then determined for each of the plurality of propulsion devices based on the desired inertial velocity and the propulsion system is controlled accordingly. An actual velocity of the marine vessel is measured and a difference between the desired inertial velocity and the actual velocity is determined, where the difference is used as feedback in subsequent steering position command and engine command determinations.

The above patents and patent publications are hereby incorporated by reference in their entireties.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to one implementation of the present disclosure, a system for orienting a marine vessel includes marine propulsion devices, a gyroscopic stabilizer system, and a manually operable control device configured to provide an output signal which is representative of a desired movement of the marine vessel. The system further includes a controller operably coupled to the marine propulsion devices, the gyroscopic stabilization system and the manually operable control device. The controller is configured to receive the output signal from the manually operable control device, resolve said desired movement of the marine vessel into a target movement command, operate the marine propulsion devices to exert a thrust on the marine vessel to achieve the target movement command, and operate the gyroscopic stabilizer system consistent with the thrust exerted by the plurality of marine propulsion devices to achieve the target movement command.

According to another implementation of the present disclosure, a method for orienting a marine vessel comprises receiving an output signal from a manually operable control device, wherein the output signal is representative of a desired movement of the marine vessel. The method further includes resolving said desired movement of the marine vessel into a target movement command, operating marine propulsion devices to exert a thrust on the marine vessel to achieve the target movement command, and operating a gyroscopic stabilizer system consistent with the thrust exerted by the marine propulsion devices to achieve the target movement command.

BRIEF DESCRIPTION OF THE DRAWINGS

The present disclosure is described with reference to the following Figures. The same numbers are used throughout the Figures to reference like features and like components.

DETAILED DESCRIPTION

Figure 2:
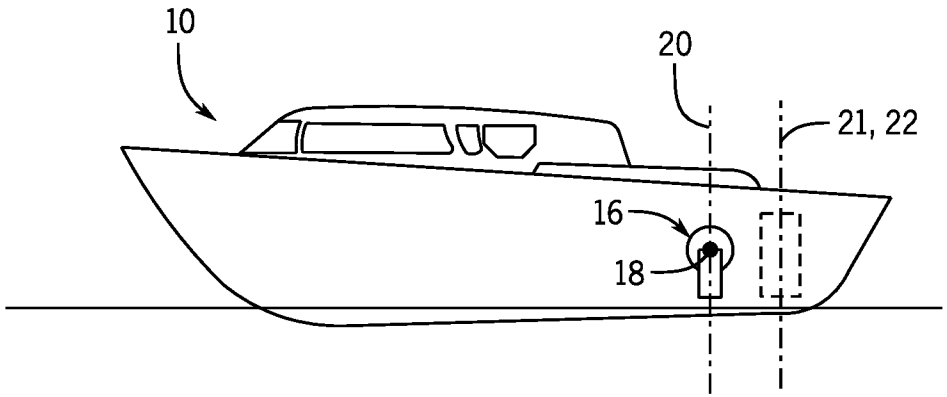
FIG. 2 is a schematic side view representation of the marine vessel of FIG. 1.

In the present description, certain terms have been used for brevity, clearness and understanding. No unnecessary limitations are to be inferred therefrom beyond the requirement of the prior art because such terms are used for descriptive purposes only and are intended to be broadly construed.

FIGS. 1-14 depict various embodiments of marine vessels and control systems for orienting and maneuvering the marine vessels. It should be understood that the particular configurations of the marine vessels and control systems are exemplary. It is possible to apply the concepts described in the present disclosure with substantially different configurations of marine vessels and/or control systems. For example, the marine vessels that are depicted in the drawing figures have first and second marine propulsion devices 27, 28 that have limited ranges or rotation. However, it should be understood that the concepts disclosed in the present disclosure are applicable to marine vessels having any number of marine propulsion devices and any configuration of a propulsion device, such as outboard marine drives, inboard drive, stern drives, pod drives, or the like. Further, the present disclosure describes certain types of user input devices (e.g., a joystick 50). However, it should also be recognized that the concepts disclosed in the present disclosure are able to function in conjunction with different types of user input devices, as would be known to one of skill in the art. Further equivalents, alternatives, and modifications are also possible as would be recognized by those skilled in the art.

Figure 1:
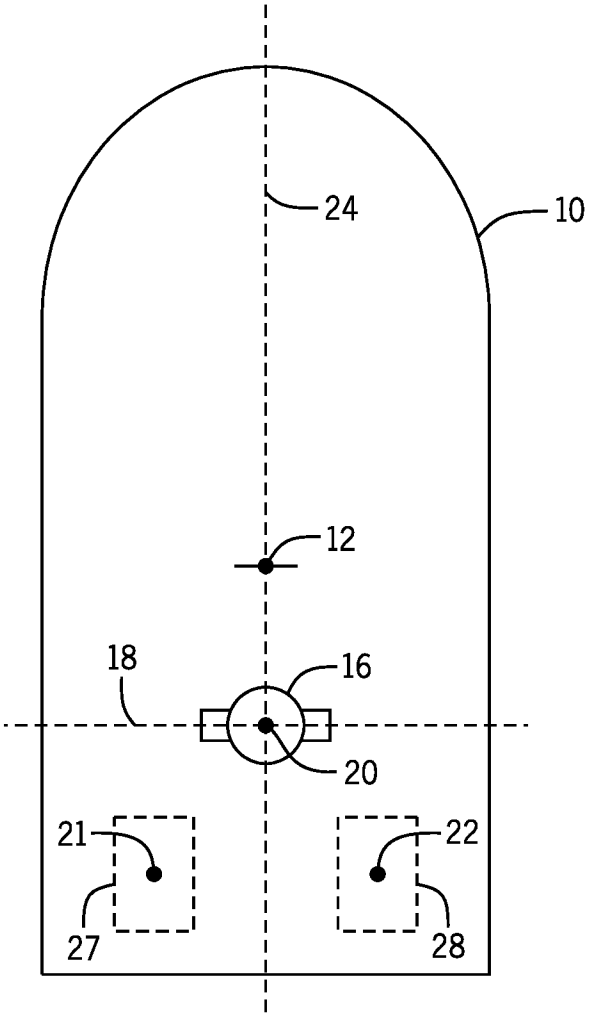
FIG. 1 is a schematic top view representation of a marine vessel having marine propulsion devices and a gyroscopic stabilizer device.

FIGS. 1 and 2 respectively depict schematic top and side view representations of a marine vessel 10 having a center of gravity 12. First and second steering axes, 21 and 22, are illustrated to represent the location of first and second marine propulsion devices 27 and 28 located under the hull of the marine vessel 10. The first and second marine propulsion devices 27 and 28 are rotatable about the first and second steering axes, 21 and 22, respectively. The first marine propulsion device 27, on the port side of a centerline 24, may be configured to be rotatable 45 degrees in a clockwise direction, viewed from above the marine vessel 10, and 15 degrees in a counterclockwise direction. The second marine propulsion device 28, located on the starboard side of the centerline 24, may be oppositely configured to rotate 15 degrees in a clockwise direction and 45 degrees in a counterclockwise direction.

FIGS. 1 and 2 additionally depict a gyroscopic stabilizer 16 that may be utilized to suppress unwanted disruptions to the orientation of the marine vessel 10 due to the forces of waves, wakes, or wind acting upon the marine vessel 10. The gyroscopic stabilizer 16 suppresses these unwanted motions by producing a stabilizing torque through controlled precession of stored angular momentum of a spinning flywheel. For example, if the gyroscopic stabilizer 16 is utilized to control roll motions of the marine vessel 10 (i.e., rotations about the centerline 24), the flywheel within the gyroscopic stabilizer 16 may spin about a vertical spin axis 20. Conservation of the angular momentum of the flywheel causes the flywheel to precess about a gimbal or precession axis 18 that is oriented across the width of the vessel, orthogonal to the spin axis 20. By controlling the precession rate about the gimbal axis 18, a control torque about the centerline 24 is induced that is directly proportional to the flywheel rotational moment of inertia about the spin axis 20, the flywheel angular velocity, and the precession rate about the gimbal axis 18. The direction of the control torque opposes the direction of the roll torque, thereby dampening any resulting roll motion induced by the roll torque, and providing the occupants of the marine vessel 10 with a more comfortable experience.

Other orientations of the gyroscopic stabilizer 16 are possible to induce an identical roll-opposing torque. For example, the gyroscopic stabilizer 16 may instead be oriented such that the flywheel rotates about axis 18 and precesses about axis 20. In addition, in an exemplary implementation, the structure of the gyroscopic stabilizer 16 may permit accommodation of any desired orientation of the spin and gimbal axes, such that the gyroscopic stabilizer 16 is oriented in real time to dampen unwanted roll, pitch, and yaw motions of the marine vessel 10. Such gyroscopic stabilizers for marine vessels, also known as control moment gyroscopes (CMGs), are known in the art and manufactured by various suppliers (e.g., Seakeeper, VEEM Gyro). The location of the gyroscopic stabilizer 16 on the marine vessel 10 may depend on various factors, including the available mounting space, proximity to cooling water access, and length of power cable runs. In some embodiments, the mounting location of the gyroscopic stabilizer 16 may not coincide with a center of gravity of the marine vessel 10. Mounting the gyroscopic stabilizer 16 away from the center of gravity increases the lever arm of the stabilizer 16 relative to the center of gravity. Since torque is a function of lever arm and force, this arrangement permits a smaller force to generate the same control torque as a larger force and shorter lever arm, thus permitting the stabilizer 16 to operate more efficiently.

Although gyroscopic stabilizers or CMGs are known in the art for their use in dampening unwanted movements of marine vessels, the utility of gyroscopic stabilizers in aiding close quarter joystick maneuvers has not been previously realized. Currently, if a gyroscopic stabilizer is operational during close quarter maneuvers, the control torques generated by the gyroscopic stabilizer do not aid the marine propulsion devices in accomplishing the maneuvers. On the contrary, in many cases, the control torques generated by the gyroscopic stabilizer oppose the thrusts generated by the marine propulsion devices, resulting in an inefficient use of energy as more power must be supplied to the marine propulsion devices to overcome the gyro control torques. The present inventor has recognized that by overriding the nominal operations of the gyroscopic stabilizer when a joystick is detected to be active and performing close quarter maneuvers, the control torques generated by a gyroscopic stabilizer may be modified to assist in achieving the desired maneuvering of the marine vessel, thereby resulting in more efficient use of energy. The integration of the gyroscopic stabilizer into the close quarter maneuvering process also results in a more intuitive experience for the joystick operator, as the operator may no longer feel as though the gyroscopic stabilizer is causing the marine vessel to "fight" the maneuvers initiated by the joystick.

Referring now to FIGS. 3-6, an overview of the thrusts and moments induced by the marine propulsion devices 27 and 28 to achieve desired movements of the marine vessel 10 is provided. For the purposes of simplicity, the effects of the gyroscopic stabilizer 16 on the marine vessel 10 on these close quarter movements are not addressed herein, but are described in further detail below with reference to FIGS. 13 and 14.

Figure 3:
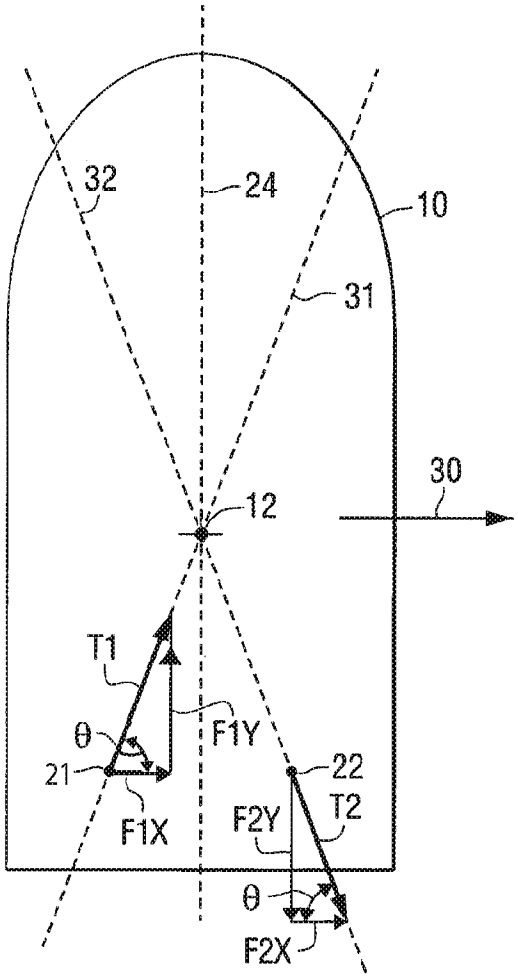
FIG. 3 illustrates the arrangement of thrust vectors during a sidle movement of the marine vessel of FIG. 1.

FIG. 3 illustrates one element of the present disclosure that is used when it is desired to move the marine vessel 10 in a direction represented by arrow 30. In other words, it represents the situation when the operator of the marine vessel wishes to cause it to sidle to the right with no movement in either a forward or reverse direction and no rotation about its center of gravity 12. This is done by rotating the first and second marine propulsion devices so that their thrust vectors, T1 and T2, are both aligned with the center of gravity 12. This provides no effective moment arm about the center of gravity 12 for the thrust vectors, T1 and T2, to exert a force that could otherwise cause the marine vessel 10 to rotate. The first and second thrust vectors, T1 and T2, are in opposite directions and are equal in magnitude to each other. This creates no resultant forward or reverse force on the marine vessel 10. The first and second thrust vectors are directed along lines 31 and 32, respectively, which intersect at the center of gravity 12. As illustrated in FIG. 3, these two lines, 31 and 32, are positioned at angles θ. As such, the first and second marine propulsion devices are rotated symmetrically relative to the centerline 24. As will be described in greater detail below, the first and second thrust vectors, T1 and T2, can be resolved into components, parallel to centerline 24, that are calculated as a function of the sine of angle θ. These thrust components in a direction parallel to centerline 24 effectively cancel each other if the thrust vectors, T1 and T2, are equal to each other since the absolute magnitudes of the angles θ are equal to each other. Movement in the direction represented by arrow 30 results from the components of the first and second thrust vectors, T1 and T2, being resolved in a direction parallel to arrow 30 (i.e. perpendicular to centerline 24) as a function of the cosine of angle θ. These two resultant thrust components which are parallel to arrow 30 are additive. As described above, the moment about the center of gravity 12 is equal to zero because both thrust vectors, T1 and T2, pass through the center of gravity 12 and, as a result, have no moment arms about that point.

While it is recognized that many other positions of the thrust, T1 and T2, may result in the desired sidling represented by arrow 30, the direction of the thrust vectors in line with the center of gravity 12 of the marine vessel 10 is most effective and is easy to implement. It also minimizes the overall movement of the propulsion devices during complicated maneuvering of the marine vessel 10. Its effectiveness results from the fact that the magnitudes of the first and second thrusts need not be perfectly balanced in order to avoid the undesirable rotation of the marine vessel 10. Although a general balancing of the magnitudes of the first and second thrusts is necessary to avoid the undesirable forward or reverse movement, no rotation about the center of gravity 12 will occur as long as the thrusts are directed along lines, 31 and 32, which intersect at the center of gravity 12 as illustrated in FIG. 3.

FIG. 3 shows the first and second thrust vectors, T1 and T2, and the resultant forces of those two thrust vectors. For example, the first thrust vector can be resolved into a forward directed force F1Y and a side directed force F1X as shown in FIG. 3 by multiplying the first thrust vector T1 by the sine of θ and the cosine of θ, respectively. Similarly, the second thrust vector T2 is shown resolved into a rearward directed force F2Y and a side directed force F2X by multiplying the second thrust vector T2 by the sine of θ and cosine of θ, respectively. Since the forward force F1Y and rearward force F2Y are equal to each other, they cancel and no resulting forward or reverse force is exerted on the marine vessel 10. The side directed forces, F1X and F2X, on the other hand, are additive and result in the sidle movement represented by arrow 30. Because the lines, 31 and 32, intersect at the center of gravity 12 of the marine vessel 10, no resulting moment is exerted on the marine vessel. As a result, the only movement of the marine vessel 10 is the sidle movement represented by arrow 30.

Figure 4:
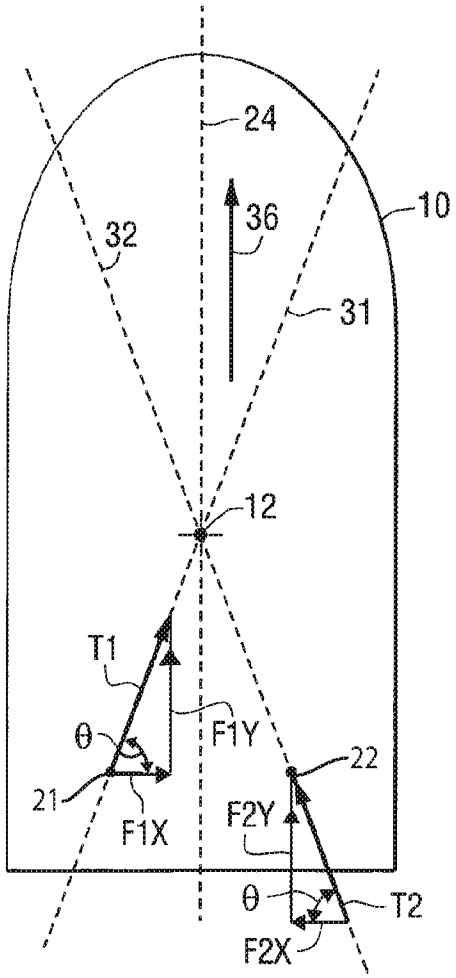
FIG. 4 illustrates the arrangement of thrust vectors during a forward movement of the marine vessel of FIG. 1.

FIG. 4 shows the result when the operator of the marine vessel 10 wishes to move in a forward direction, with no side movement and no rotation about the center of gravity 12. The first and second thrusts, T1 and T2, are directed along their respective lines, 31 and 32, and they intersect at the center of gravity 12. Both thrusts, T1 and T2, are exerted in a generally forward direction along those lines. As a result, these thrusts resolve into the forces illustrated in FIG. 4. Side directed forces FIX and F2X are equal to each other and in opposite directions. Therefore, they cancel each other and no sidle force is exerted on the marine vessel 10. Forces F1Y and F2Y, on the other hand, are both directed in a forward direction and result in the movement represented by arrow 36. The configuration of the first and second marine propulsion systems represented in FIG. 4 result in no side directed movement of the marine vessel 10 or rotation about its center of gravity 12. Only a forward movement 36 occurs.

Figure 5:
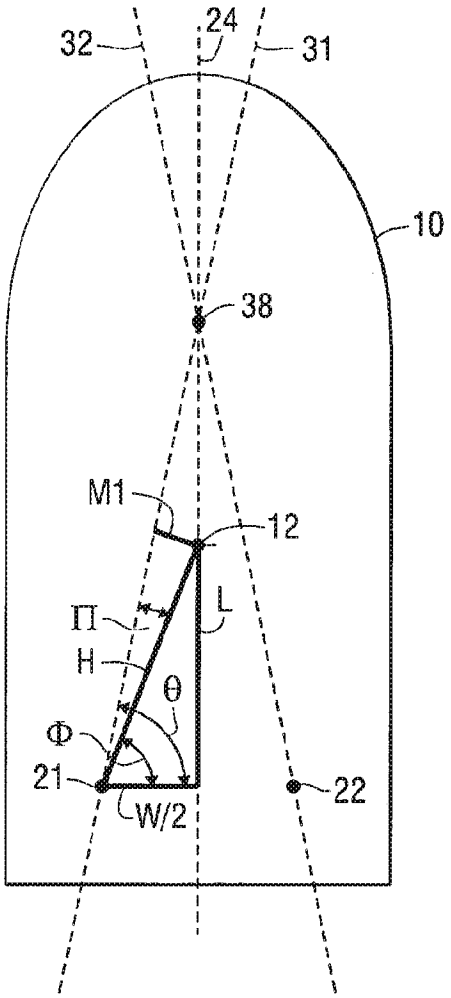
FIG. 5 illustrates the geometry associated with the calculation of a moment arm relative to the center of gravity of the marine vessel of FIG. 1.

When a rotation or yaw motion of the marine vessel 10 is desired in combination with linear movement, the first and second marine propulsion devices are rotated so that their thrust vectors intersect at a point on the centerline 24 other than the center of gravity 12 of the marine vessel 10. This is illustrated in FIG. 5. Although the thrust vectors, T1 and T2, are not shown in FIG. 5, their associated lines, 31 and 32, are shown intersecting at a point 38 which is not coincident with the center of gravity 12. As a result, an effective moment arm M1 exists with respect to the first marine propulsion device which is rotated about its first steering axis 21. Moment arm M1 is perpendicular to dashed line 31 along which the first thrust vector is aligned. As such, it is one side of a right triangle which also comprises a hypotenuse H. It should also be understood that another right triangle in FIG. 5 comprises sides L, W/2, and the hypotenuse H. Although not shown in FIG. 5, for purposes of clarity, a moment arm M2 of equal magnitude to moment arm M1 would exist with respect to the second thrust vector directed along line 32. Because of the intersecting nature of the thrust vectors, they each resolve into components in both the forward/reverse and left/right directions. The components, if equal in absolute magnitude to each other, may either cancel each other or be additive. If unequal in absolute magnitude, they may partially offset each other or be additive. However, a resultant force will exist in some linear direction when the first and second thrust vectors intersect at a point 38 on the centerline 24.

With continued reference to FIG. 5, those skilled in the art recognize that the length of the moment arm M1 can be determined as a function of angle θ, angle Φ, angle Π, the distance between the first and second steering axes, 21 and 22, which is equal to W in FIG. 5, and the perpendicular distance between the center of gravity 12 and a line extending between the first and second steering axes. This perpendicular distance is identified as L in FIG. 5. The length of the line extending between the first steering axis 21 and the center of gravity 12 is the hypotenuse of the triangle shown in FIG. 5 and can easily be determined. The magnitude of angle 1 is equivalent to the arctangent of the ratio of length L to the distance between the first steering axis 21 and the centerline 24, which is identified as W/2 in FIG. 5. Since the length of line H is known and the magnitude of angle H is known, the length of the moment arm M1 can be mathematically determined.

Figure 6:
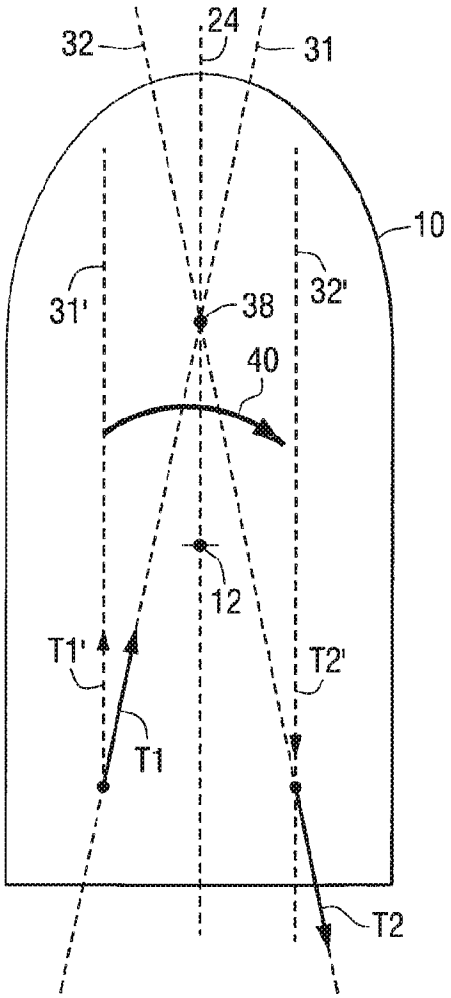
FIG. 6 depicts the arrangement of thrust vectors used to rotate the marine vessel of FIG.

As described above, a moment, represented by arrow 40 in FIG. 6, can be imposed on the marine vessel 10 to cause it to rotate about its center of gravity 12. The moment can be imposed in either rotational direction. In addition, the rotating force resulting from the moment 40 can be applied either in combination with a linear force on the marine vessel or alone. In order to combine the moment 40 with a linear force, the first and second thrust vectors, T1 and T2, are positioned to intersect at the point 38 illustrated in FIG. 6. The first and second thrust vectors, T1 and T2, are aligned with their respective dashed lines, 31 and 32, to intersect at this point 38 on the centerline 24 of the marine vessel. If, on the other hand, it is desired that the moment 40 be the only force on the marine vessel 10, with no linear forces, the first and second thrust vectors, represented by T1' and T2' in FIG. 6, are aligned in parallel association with each other. This, effectively, causes angle θ to be equal to 90 degrees. If the first and second thrust vectors, T1' and T2', are then applied with equal magnitudes and in opposite directions, the marine vessel 10 will be subjected only to the moment 40 and to no linear forces. This will cause the marine vessel 10 to rotate about its center of gravity 12 while not moving in either the forward/reverse or the left/right directions.

In FIG. 6, the first and second thrust vectors, T1 and T2, are directed in generally opposite directions and aligned to intersect at the point 38 which is not coincident with the center of gravity 12. Although the construction lines are not shown in FIG. 6, effective moment arms, M1 and M2, exist with respect to the first and second thrust vectors and the center of gravity 12. Therefore, a moment is exerted on the marine vessel 10 as represented by arrow 40. If the thrust vectors T1 and T2 are equal to each other and are exerted along lines 31 and 32, respectively, and these are symmetrical about the centerline 24 and in opposite directions, the net component forces parallel to the centerline 24 are equal to each other and therefore no net linear force is exerted on the marine vessel 10 in the forward/reverse directions. However, the first and second thrust vectors, T1 and T2, also resolve into forces perpendicular to the centerline 24 which are additive. As a result, the marine vessel 10 in FIG. 6 will move toward the right as it rotates in a clockwise direction in response to the moment 40.

In order to obtain a rotation of the marine vessel 10 with no lateral movement in the forward/reverse or left/right directions, the first and second thrust vectors, represented as T1' and T2' in FIG. 6, are directed along dashed lines, 31' and 32', which are parallel to the centerline 24. The first and second thrust vectors, T1' and T2', are of equal and opposite magnitude. As a result, no net force is exerted on the marine vessel 10 in a forward/reverse direction. Since angle θ, with respect to thrust vectors T1' and T2', is equal to 90 degrees, no resultant force is exerted on the marine vessel 10 in a direction perpendicular to the centerline 24. As a result, a rotation of the marine vessel 10 about its center of gravity 12 is achieved with no linear movement.

Figure 7:
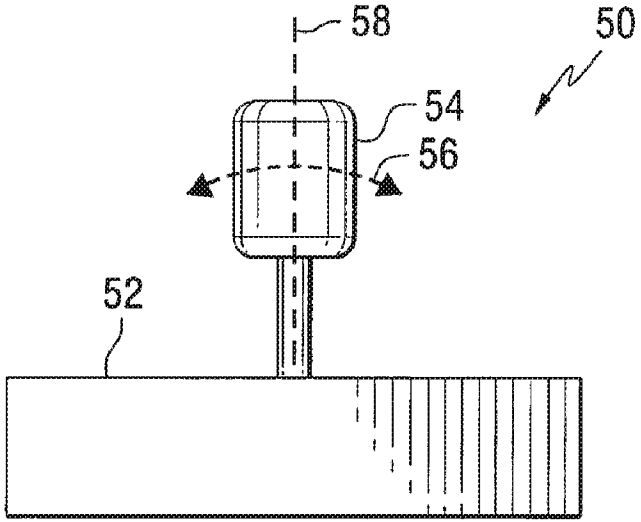
FIG. 7 is a schematic representation of a joystick used in conjunction with the marine vessel of FIG. 1.

FIG. 7 is a simplified schematic representation of a joystick 50 which provides a manually operable control device which can be used to provide a signal that is representative of a desired movement, selected by an operator, relating to the marine vessel. Many different types of joysticks are known to those skilled in the art. The schematic representation in FIG. 7 shows a base portion 52 and a handle 54 which can be manipulated by hand. In a typical application, the handle is movable in the direction generally represented by arrow 56 and is also rotatable about an axis 58. It should be understood that the joystick handle 54 is movable, by tilting it about its connection point in the base portion 52 in virtually any direction. Although dashed line 56 is illustrated in the plane of the drawing in FIG. 7, a similar type movement is possible in other directions that are not parallel to the plane of the drawing.

Figure 8:
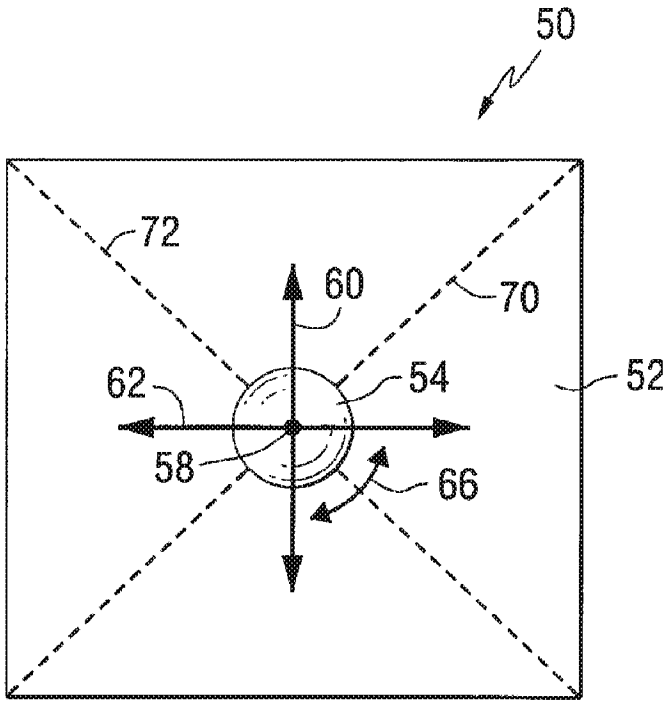
FIG. 8 is another schematic representation of a joystick used in conjunction with the marine vessel of FIG. 1.

FIG. 8 is a top view of the joystick 50. The handle 54 can move, as indicated by arrow 56 in FIG. 7, in various directions which include those represented by arrows 60 and 62. However, it should be understood that the handle 54 can move in any direction relative to axis 58 and is not limited to the two lines of movement represented by arrows 60 and 62. In fact, the movement of the handle 54 has a virtually infinite number of possible paths as it is tilted about its connection point within the base 52. The handle 54 is also rotatable about axis 58, as represented by arrow 66. Those skilled in the art are familiar with many different types of joystick devices that can be used to provide a signal that is representative of a desired movement of the marine vessel, as expressed by the operator of the marine vessel through movement of the handle 54.

With continued reference to FIG. 8, it can be seen that the operator can demand a purely linear movement either toward port or starboard, as represented by arrow 62, a purely linear movement in a forward or reverse direction as represented by arrow 60, or any combination of the two. In other words, by moving the handle 54 along dashed line 70, a linear movement toward the right side and forward or toward the left side and rearward can be commanded. Similarly, a linear movement along lines 72 could be commanded. Also, it should be understood that the operator of the marine vessel can request a combination of sideways or forward/reverse linear movement in combination with a rotation as represented by arrow 66. Any of these possibilities can be accomplished through use of the joystick 50. The magnitude, or intensity, of movement represented by the position of the handle 54 is also provided as an output from the joystick. In other words, if the handle 54 is moved slightly toward one side or the other, the commanded thrust in that direction is less than if, alternatively, the handle 54 was moved by a greater magnitude away from its vertical position with respect to the base 52. Furthermore, rotation of the handle 54 about axis 58, as represented by arrow 66, provides a signal representing the intensity of desired movement. A slight rotation of the handle about axis 58 would represent a command for a slight rotational thrust about the center of gravity 12 of the marine vessel 10. On the other hand, a more intense rotation of the handle 54 about its axis would represent a command for a higher magnitude of rotational thrust.

With reference to FIGS. 1-8, it can be seen that movement of the joystick handle 54 can be used by the operator of the marine vessel 10 to represent virtually any type of desired movement of the vessel. In response to receiving a signal from the joystick 50, an algorithm, in accordance with a preferred embodiment, determines whether or not a rotation 40 about the center of gravity 12 is requested by the operator. If no rotation is requested, the first and second marine propulsion devices are rotated so that their thrust vectors align, as shown in FIGS. 3 and 4, with the center of gravity 12 and intersect at that point. This results in no moment being exerted on the marine vessel 10 regardless of the magnitudes or directions of the first and second thrust vectors, T1 and T2. The magnitudes and directions of the first and second thrust vectors are then determined mathematically, as described above in conjunction with FIGS. 3 and 4.

If, on the other hand, the signal from the joystick 50 indicates that a rotation about the center of gravity 12 is requested, the first and second marine propulsion devices are directed along lines, 31 and 32, that do not intersect at the center of gravity 12. Instead, they intersect at another point 38 along the centerline 24. As shown in FIG. 6, this intersection point 38 can be forward from the center of gravity 12. The thrusts, T1 and T2, shown in FIG. 6 result in a clockwise rotation 40 of the marine vessel 10. Alternatively, if the first and second marine propulsion devices are rotated so that they intersect at a point along the centerline 24 which is behind the center of gravity 12, an opposite effect would be realized. It should also be recognized that, with an intersect point 38 forward from the center of gravity 12, the directions of the first and second thrusts, T1 and T2, could be reversed to cause a rotation of the marine vessel 10 in a counterclockwise direction.

Propellers do not have the same effectiveness when operated in reverse gear than they do when operated in forward gear for a given rotational speed. Therefore, with reference to FIG. 3, the first thrust T1 would not be perfectly equal to the second thrust T2 if the two propellers systems were operated at identical rotational speeds. In order to determine the relative efficiency of the propellers when they are operated in reverse gear, a relatively simple calibration procedure can be followed. With continued reference to FIG. 3, first and second thrusts, T1 and T2, are provided in the directions shown and aligned with the center of gravity 12. This should produce the sidle movement 30 as illustrated. However, this assumes that the two thrust vectors, T1 and T2, are equal to each other. In a typical calibration procedure, it is initially assumed that the reverse operating propeller providing the second thrust T2 would be approximately 80% as efficient as the forward operating propeller providing the first thrust vector T1. The rotational speeds were selected accordingly, with the second marine propulsion device operating at 125% of the speed of the first marine propulsion device. If a forward or reverse movement is experienced by the marine vessel 10, that initial assumption would be assumed to be incorrect. By slightly modifying the assumed efficiency of the reverse operating propeller, the system can eventually be calibrated so that no forward or reverse movement of the marine vessel 10 occurs under the situation illustrated in FIG. 3. In an actual example, this procedure was used to determine that the operating efficiency of the propellers, when in reverse gear, is approximately 77% of their efficiency when operated in forward gear. Therefore, in order to balance the first and second thrust vectors, T1 and T2, the reverse operating propellers of the second marine propulsion device would be operated at a rotational speed (i.e. RPM) which is approximately 29.87% greater than the rotational speed of the propellers of the first marine propulsion device. Accounting for the inefficiency of the reverse operating propellers, this technique would result in generally equal magnitudes of the first and second thrust vectors, T1 and T2.

Figure 9:
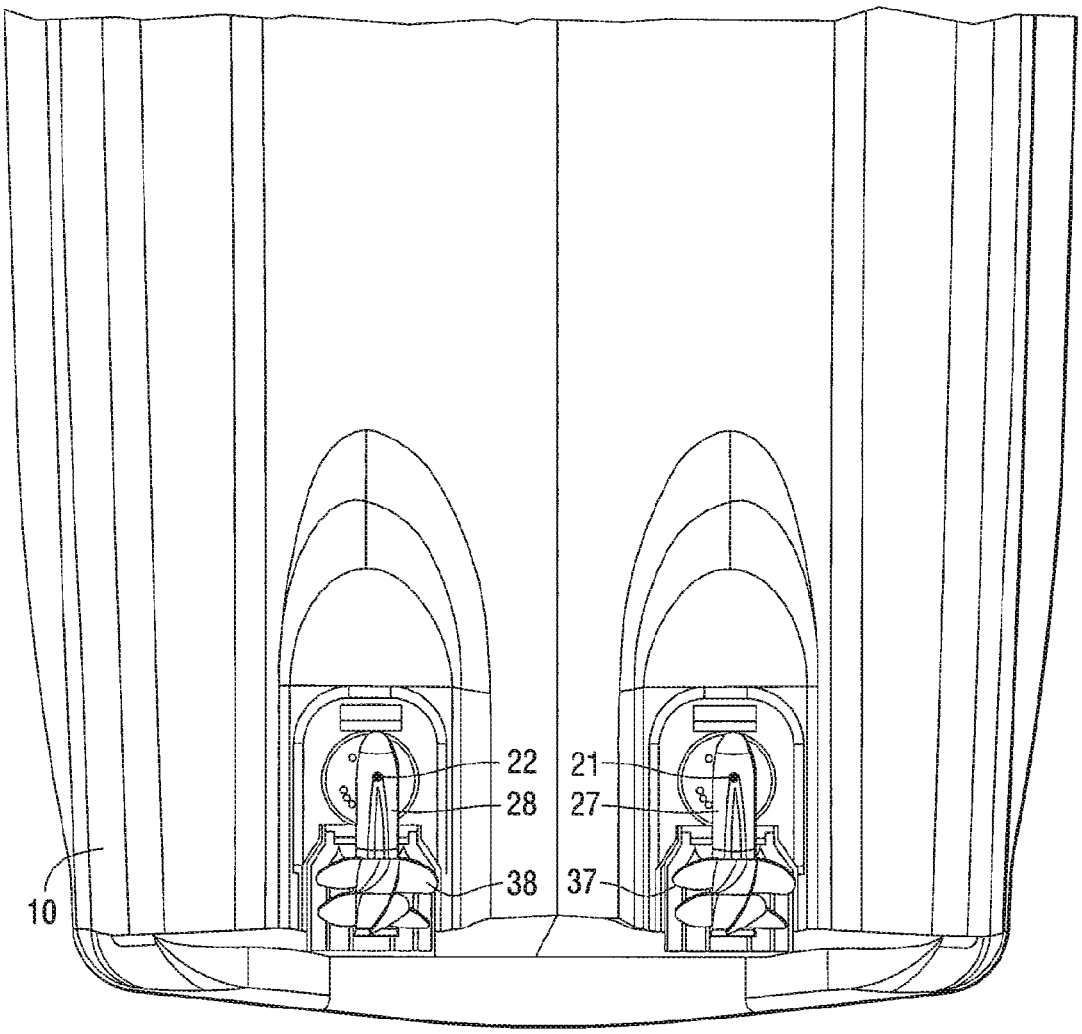
FIG. 9 is a bottom view of the hull of a marine vessel showing the first and second marine propulsion devices extending therethrough.

FIG. 9 is an isometric view of the bottom portion of a hull of a marine vessel 10, showing first and second marine propulsion devices, 27 and 28, and propellers, 37 and 38, respectively. The first and second marine propulsion devices, 27 and 28, are rotatable about generally vertical steering axes, 21 and 22, as described above. In order to avoid interference with portions of the hull of the marine vessel 10, the two marine propulsion devices are provided with limited rotational steering capabilities as described above. Neither the first nor the second marine propulsion device is provided, in a particularly preferred embodiment of the present disclosure, with the capability of rotating 360 degrees about its respective steering axis, 21 or 22.

Figure 10:
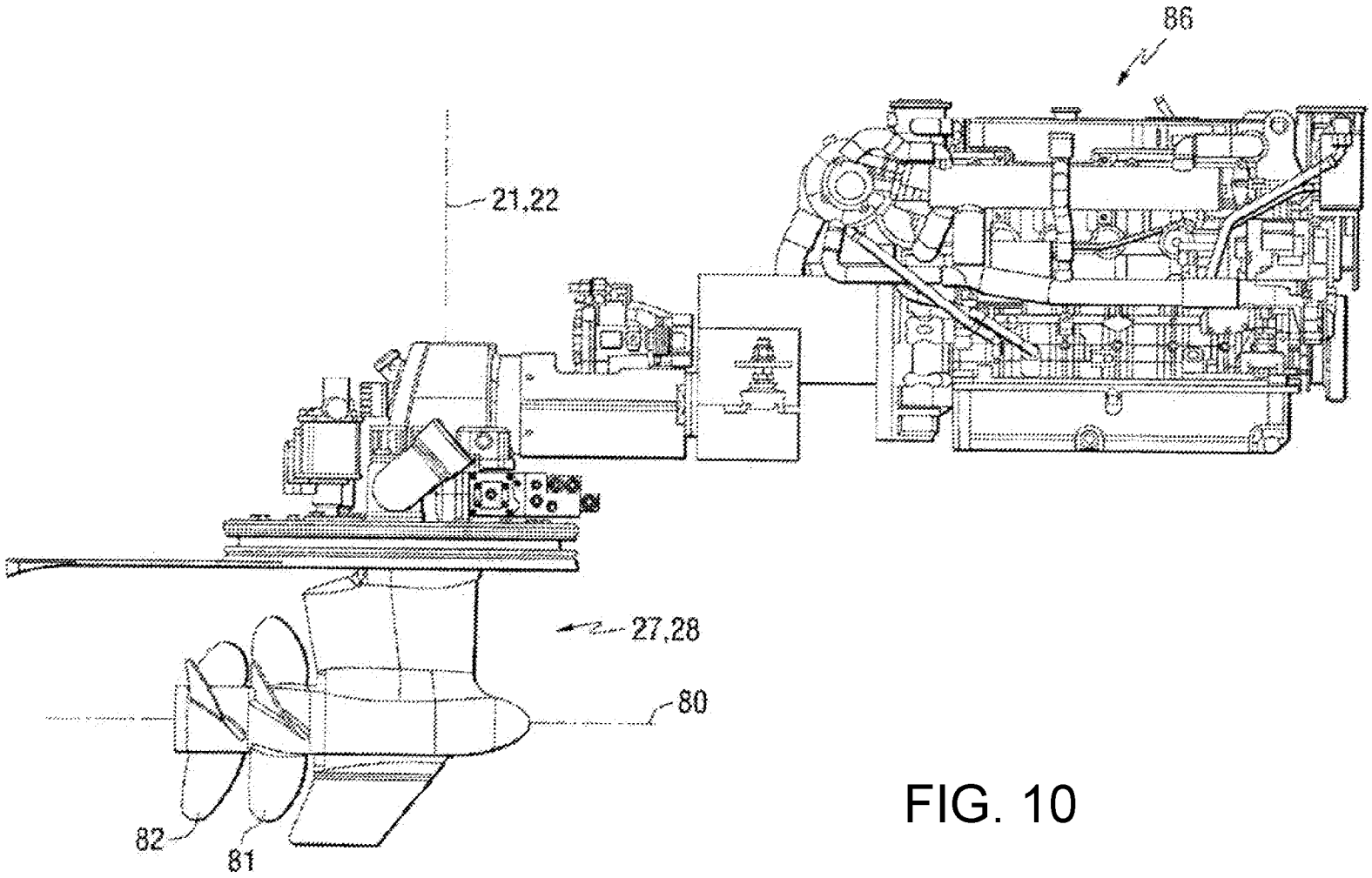
FIG. 10 is a side view showing the arrangement of an engine, steering mechanism, and marine propulsion device used in conjunction with the presently described embodiments.

FIG. 10 is a side view showing the arrangement of a marine propulsion device, such as 27 or 28, associated with a mechanism that is able to rotate the marine propulsion device about its steering axis, 21 or 22. Although not visible in FIG. 10, the driveshaft of the marine propulsion device extends vertically and parallel to the steering axis and is connected in torque transmitting relation with a generally horizontal propeller shaft that is rotatable about a propeller axis 80. The embodiment shown in FIG. 10 comprises two propellers, 81 and 82, that are attached to the propeller shaft. The motive force to drive the propellers, 81 and 82, is provided by an internal combustion engine 86 that is located within the bilge of the marine vessel 10. It is configured with its crankshaft aligned for rotation about a horizontal axis. In a particularly preferred embodiment, the engine 86 is a diesel engine. Each of the two marine propulsion devices, 27 and 28, is driven by a separate engine 86. In addition, each of the marine propulsion devices, 27 and 28, are independently steerable about their respective steering axes, 21 or 22. The steering axes, 21 and 22, are generally vertical and parallel to each other. They are not intentionally configured to be perpendicular to the bottom surface of the hull. Instead, they are generally vertical and intersect the bottom surface of the hull at an angle that is not equal to 90 degrees when the bottom surface of the hull is a V-type hull or any other shape which does not include a flat bottom.

With continued reference to FIG. 10, the submerged portion of the marine propulsion device, 27 or 28, contains rotatable shafts, gears, and bearings which support the shafts and connect the driveshaft to the propeller shaft for rotation of the propellers. No source of motive power is located below the hull surface. The power necessary to rotate the propellers is solely provided by the internal combustion engine. Alternate propulsion means could be employed such as an electronic motor and/or the like.

Figure 11:
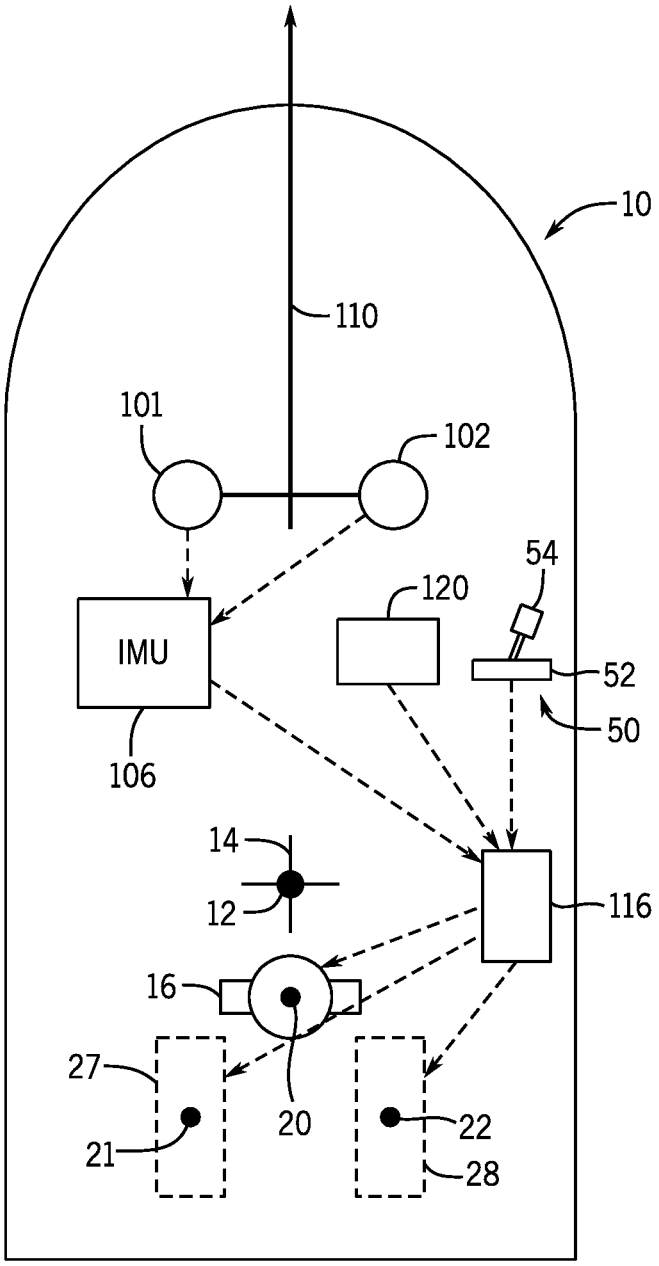
FIG. 11 is a schematic representation of a marine vessel equipped with the devices for performing the gyroscope-assisted joystick maneuvering functions of the presently described embodiments.

FIG. 11 is a schematic representation of a marine vessel 10 which is configured to perform the steps of a preferred embodiment relating to a method for maintaining a marine vessel in a selected position. The marine vessel 10 is provided with a global positioning system (GPS) which, in a preferred embodiment, comprises a first GPS device 101 and a second GPS device 102 which are each located at a preselected fixed position on the marine vessel 10. Signals from the GPS devices are provided to an inertial measurement unit (IMU) 106. In certain embodiments of the IMU 106, it comprises a differential correction receiver, accelerometers, angular rate sensors, and a microprocessor which manipulates the information obtained from these devices to provide information relating to the current position of the marine vessel 10, in terms of longitude and latitude, the current heading of the marine vessel 10, represented by arrow 110 in FIG. 11, and the velocity and acceleration of the marine vessel 10 in six degrees of freedom.

FIG. 11 also shows a microprocessor or controller 116 which receives inputs from the IMU 106. The microprocessor 116 also receives information from a device 120 which allows the operator of the marine vessel 10 to provide manually selectable modes of operation. As an example, the device 120 can be an input screen that allows the operator of the marine vessel to manually select various modes of operation associated with the marine vessel 10. One of those selections made by the operator of the marine vessel can provide an enabling signal which informs the microprocessor 116 that the operator desires to operate the vessel 10 in a station keeping mode in order to maintain the position of the marine vessel in a selected position. In other words, the operator can use the device 120 to activate the present system so that the marine vessel 10 is maintained at a selected global position (e.g. a selected longitude and latitude) and a selected heading (e.g. with arrow 110 being maintained at a fixed position relative to a selected compass point).

With continued reference to FIG. 11, a manually operable control device, such as the joystick 50, can also be used to provide a signal to the microprocessor 116. As described above, the joystick 50 can be used to allow the operator of the marine vessel 10 to manually maneuver the marine vessel. It can also provide information to the microprocessor 116 regarding its being in an active status or inactive status. While the operator is manipulating the joystick 50, the joystick is in an active status. However, if the operator releases the joystick 50 and allows the handle 54 to return to its centered and neutral position, the joystick 50 reverts to an inactive status. As will be described in greater detail below with reference to FIGS. 12 and 13, a particularly preferred embodiment can use the information relating to the active or inactive status of the joystick 50 to determine whether to override nominal operations of the gyroscopic stabilizer 16. In other embodiments, the operator may selectively engage or disengage the override of the nominal operations of the gyroscopic stabilizer 16 using the input screen on the device 120.

As described above, the first and second marine propulsion devices, 27 and 28, are steerable about their respective axes, 21 and 22. Signals provided by the microprocessor 116 allow the first and second marine propulsion devices to be independently rotated about their respective steering axes in order to coordinate the movement of the marine vessel 10 in response to operator commands.

As was also described above, the orientation of the precession and spin axes 18, 20 of the gyroscopic stabilizer 16 can be modified to generate a control torque having a desired orientation. Signals provided by the microprocessor 116 to the gyroscopic stabilizer 16 direct the orientation of the precession and spin axes 18, 20, as well as the spin rate of the flywheel to achieve the desired control torque.

Figure 12:
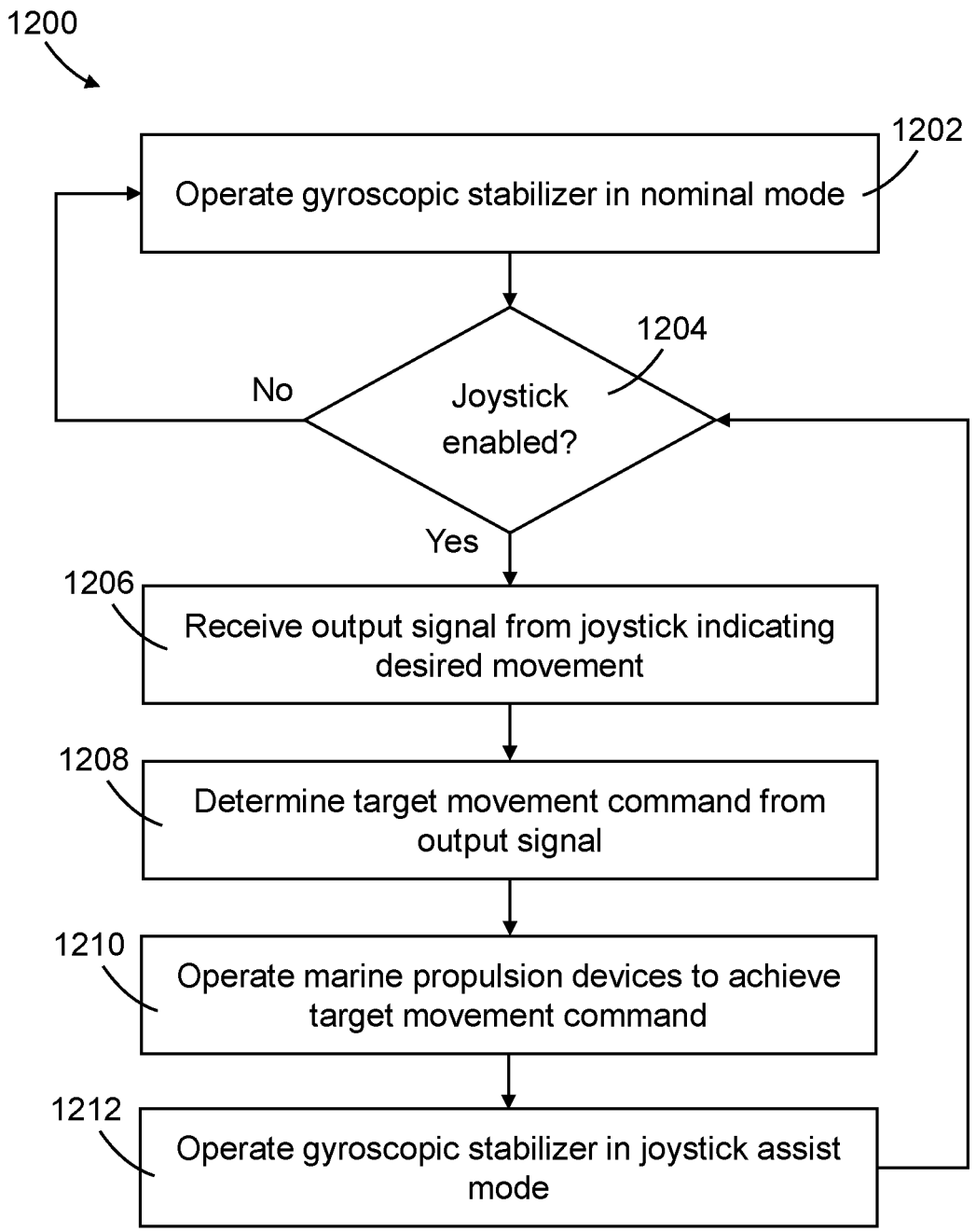
FIG. 12 is a flow chart depicting a process for performing a gyroscope-assisted maneuvering process.

FIG. 12 depicts a process 1200 for performing gyroscope-assisted maneuvering using the marine vessel 10, depicted and described above with reference to FIGS. 1-11. In an exemplary implementation, process 1200 is performed at least in part by the microprocessor or controller 116. Process 1200 is shown to commence with step 1202, in which the controller 116 operates the gyroscopic stabilizer 16 in a nominal mode. While operating in the nominal mode, the signals provided to the gyroscopic stabilizer 16 from the controller 116 cause the gyroscopic stabilizer 16 to generate control torques that oppose the forces acting upon the marine vessel 10. For example, if the direction of the waves cause a resultant moment or yaw motion that rotates the boat in a clockwise direction, the controller 116 operates the gyroscopic stabilizer 16 to generate a control torque in a counter-clockwise direction.

At step 1204, the controller 116 determines whether the joystick 50 is enabled or in an active status. As described above, when the operator is manipulating the joystick 50, the joystick is in an enabled or active status and output signals indicative of the active status are provided to the microprocessor 116. If the controller 116 does not receive any signals indicating that the joystick 50 is enabled at step 1204, process 1200 reverts to step 1202 and the microprocessor 116 continues to operate the gyroscopic stabilizer 16 in the nominal mode to oppose the forces acting upon the marine vessel 10. However, if the controller 116 does receive signals at step 1204 indicating that the joystick 50 is enabled, process 1200 proceeds to step 1206. In other embodiments, the controller 116 may utilize a different input other than the active status of the joystick 50 at step 1204. For example, the controller 116 may rely on an automated control feature or an operator preference.

At step 1206, the controller 116 receives an output signal from the joystick 50 indicating the desired movement of the marine vessel 10. As described above, the joystick 50 can be used by the operator to demand virtually any type of desired movement, including a purely linear sidle movement toward port or starboard (see FIG. 3), a purely linear movement in a forward or reverse direction (see FIG. 4), a rotation about the center of gravity (see FIG. 6) or a combination of any of these movements. Upon receiving the output signal from the joystick 50, the microprocessor 116 determines a target movement command at step 1208 through use of an algorithm. In some embodiments, the target movement command comprises a target linear thrust component and a target moment component. In other embodiments, the target movement command comprises a desired inertial velocity in conjunction with a velocity control system. Further details of an exemplary velocity control system are included in U.S. Pat. Nos. 10,671,073 and 10,926,855, incorporated by reference herein in its entirety.

At step 1210, the microprocessor 116 transmits signals to operate the marine propulsion devices 27, 28 according to the target movement command determined in step 1208. These signals may include the rotational propeller speeds and device rotation necessary to achieve the target linear thrust and target moment. For example, if the microprocessor 116 determines that the operator has manipulated the joystick 50 consistent with a pure clockwise rotational movement, the microprocessor 116 may transmit a signal that causes the marine propulsion device 27 to generate a forward linear thrust (see thrust vector T1' of FIG. 6) and marine propulsion device 28 to generate a rearward linear thrust (see thrust vector T2' of FIG. 6). As described above, since the thrust vectors T1' and T2' are parallel to each other, a moment (see arrow 40 of FIG. 6) is imposed on the marine vessel 10 about its center of gravity 12.

At step 1212, the microprocessor transmits signals to the gyroscopic stabilizer 16 to operate the gyroscopic stabilizer 16 in a joystick assist or override mode. These signals may include the flywheel spin rate, spin axis orientation, and precession axis orientation required to create a control torque consistent with the target movement command used to operate the marine propulsion devices 27, 28 and any moment generated by the marine propulsion devices 27, 28. The magnitude of the control torque may depend on the capabilities of the gyroscopic stabilizer 16. In some embodiments, an operator may set an "operating envelope" of minimum and maximum control torque values using the input screen on the device 120. In other embodiments, the controller 116 may include a dynamic control algorithm which optimizes the magnitude of the control torque according to the capabilities of the gyroscopic stabilizer 16.

Upon operating the gyroscopic stabilizer 16 to generate a control torque consistent with the target movement command, process 1200 concludes by reverting to step 1204, in which the microprocessor 116 awaits a signal indicating that the joystick 50 is active. If the joystick 50 is no longer active or enabled, the microprocessor 116 reverts operation of the gyroscopic stabilizer 16 to nominal mode, in which the gyroscopic stabilizer 16 operates to generate control torques that dampen roll, pitch, and yaw movements of the marine vessel 10.

Figure 14:
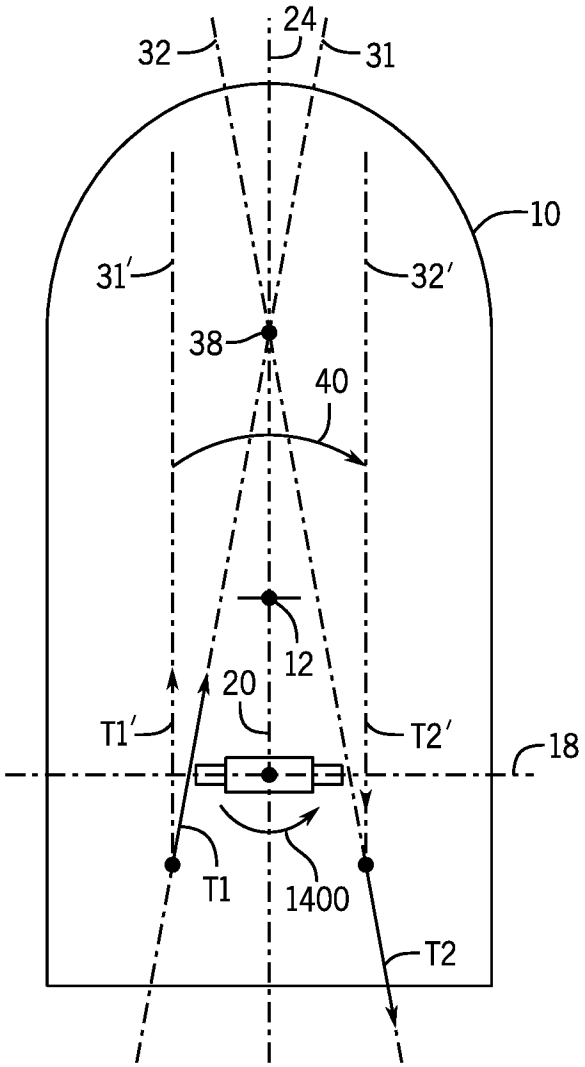
FIG. 14 is another schematic top view representation of the thrust vectors and gyroscopic torque acting upon the marine vessel of FIG. 1 when the gyroscopic stabilizer device is operating in a nominal mode.
Figure 13:
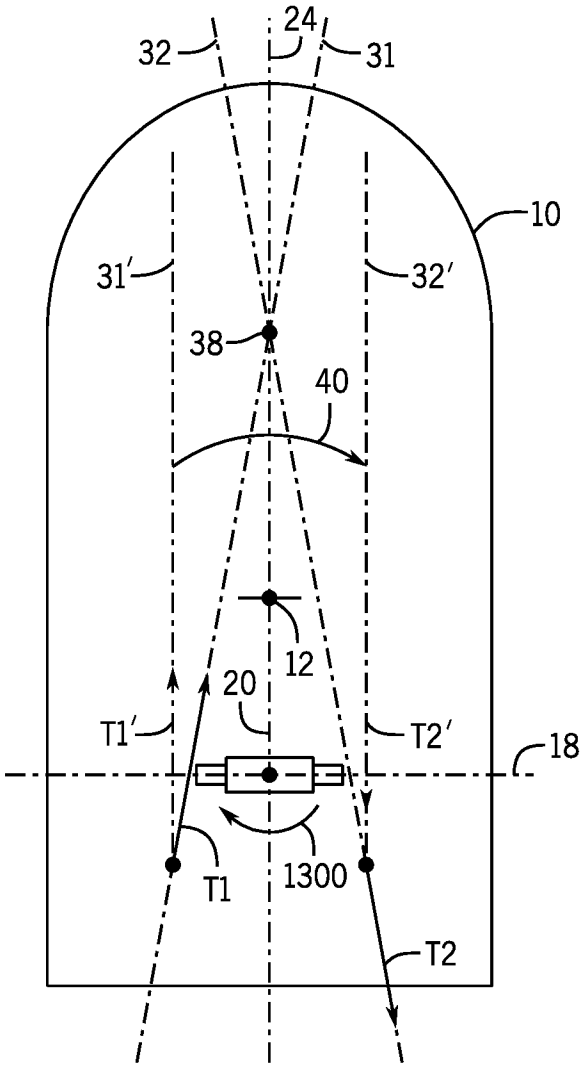
FIG. 13 is a schematic top view representation of the thrust vectors and gyroscopic torque used to rotate the marine vessel of FIG. 1 according to the gyroscope-assisted joystick maneuvering functions of the presently described embodiments.

Referring now to FIGS. 13 and 14, schematics illustrating the operation of the gyroscopic stabilizer 16 in joystick assist and nominal modes are respectively depicted. When the microprocessor 116 has commanded the gyroscopic stabilizer 16 to operate in the joystick assist or override mode, as depicted in FIG. 13, the gyroscopic stabilizer 16 generates a control torque 1300 in a clockwise direction that is additive with the moment 40 generated by the linear thrusts T1' and T2' of the marine propulsion devices. By contrast, when the gyroscopic stabilizer 16 is operating in the nominal mode according to known methods, detection of the moment 40 generated by the linear thrusts T1' and T2' will cause the gyroscopic stabilizer 16 to generate a control torque 1400 in a counterclockwise direction, thereby decreasing the efficiency of the marine propulsion devices and resulting in a sub-optimal experience for the occupants of the marine vessel 10.

FIGS. 13 and 14 depict the effects of the gyroscopic stabilizer 16 when the operator commands a rotational movement of the vessel using the joystick 50. However, the joystick assist or override mode may also prove useful when the operator commands a sidle movement of the vessel 10 using the joystick 50, as is depicted in FIG. 3. Depending on the geometry of the boat hull, commanding a sidle movement in the starboard direction (see arrow 30) may cause the vessel 10 to roll about the centerline 24 towards the starboard side of the vessel 10 due to hydrodynamic drag. When the gyroscopic stabilizer 16 is operating in nominal mode, the stabilizer 16 generates a control torque in the opposite direction, attempting to quench the induced roll movement by causing the vessel 10 to roll about the centerline 24 towards the port side of the vessel 10. However, if the gyroscopic stabilizer 16 is operating in the joystick assist or override mode, the control torque generated by the stabilizer 16 may instead act in the same roll direction as the movement induced by the sidle command, thereby increasing the efficiency of the marine propulsion devices.

In the present disclosure, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

What is claimed is:

1. A system for orienting a marine vessel, comprising:

a plurality of marine propulsion devices;

a gyroscopic stabilizer system configured to generate a control torque using a spinning flywheel;

a manually operable control device which is configured to provide an output signal which is representative of a desired movement of the marine vessel; and a controller operably coupled to the plurality of marine propulsion devices, the gyroscopic stabilization system and the manually operable control device, wherein the controller is configured to:

receive the output signal from the manually operable control device;

resolve said desired movement of the marine vessel into a target movement command;

operate the plurality of marine propulsion devices to exert a thrust on the marine vessel to achieve the target movement command; and operate the gyroscopic stabilizer system consistent with the thrust exerted by the plurality of marine propulsion devices to achieve the target movement command, wherein operating the gyroscopic stabilizer system consistent with the thrust exerted by the plurality of marine propulsion devices comprises generating the control torque in the same direction as a moment generated by the plurality of marine propulsion devices.

2. The system of claim 1, wherein the manually operable control device comprises a joystick.

3. The system of claim 1, wherein the desired movement of the marine vessel comprises a sidle movement of the marine vessel.

4. The system of claim 1, wherein the desired movement of the marine vessel comprises a rotation of the marine vessel.

5. The system of claim 1, wherein the-flywheel is configured to rotate about a spin axis and wherein the gyroscopic stabilizer system further comprises a flywheel support structure that permits the flywheel to precess about a precession axis.

6. The system of claim 5, wherein generating the control torque in the same direction as the moment generated by the plurality of marine propulsion devices comprises modifying the orientation of at least one of the spin axis and the precession axis.

7. The system of claim 1, wherein the controller is further configured to determine that the manually operable control device is enabled.

8. The system of claim 7, wherein determining that the manually operable control device is enabled comprises receiving an active signal from the manually operable control device.

9. The system of claim 1, wherein operating the gyroscopic stabilizer system consistent with the thrust exerted by the plurality of marine propulsion devices is based on a determination that the gyroscopic stabilizer system is operating in an override mode.

10. A method for orienting a marine vessel, comprising:

receiving an output signal from a manually operable control device, wherein the output signal is representative of a desired movement of the marine vessel;

resolving said desired movement of the marine vessel into a target movement command;

operating a plurality of marine propulsion devices to exert a thrust on the marine vessel to achieve the target movement command; and operating a gyroscopic stabilizer system configured to generate a control torque using a spinning flywheel consistent with the thrust exerted by the plurality of marine propulsion devices to achieve the target movement command, wherein operating the gyroscopic stabilizer system consistent with the thrust exerted by the plurality of marine propulsion devices comprises generating the control torque in the same direction as a moment generated by the plurality of marine propulsion devices.

11. The method of claim 10, wherein the manually operable control device comprises a joystick.

12. The method of claim 10, wherein the desired movement of the marine vessel comprises a sidle movement of the marine vessel.

13. The method of claim 10, wherein the desired movement of the marine vessel comprises a rotation of the marine vessel.

14. The method of claim 10, wherein the flywheel is configured to rotate about a spin axis and wherein the gyroscopic stabilizer system further comprises a flywheel support structure that permits the flywheel to precess about a precession axis.

15. The method of claim 14, wherein generating the control torque in the same direction as the target moment comprises modifying the orientation of at least one of the spin axis and the precession axis.

16. The method of claim 10, further comprising determining that the manually operable control device is enabled.

17. The method of claim 16, wherein determining that the manually operable control device is enabled comprises receiving an active signal from the manually operable control device.

18. The method of claim 10, wherein operating the gyroscopic stabilizer system consistent with the thrust exerted by the plurality of marine propulsion devices is based on a determination that the gyroscopic stabilizer system is operating in an override mode.

* * * * *